US009967657B1

(12) United States Patent
Wang

(10) Patent No.: US 9,967,657 B1
(45) Date of Patent: May 8, 2018

(54) DIRECTIONAL LOUDSPEAKER BOX WITH DIRECTIONAL ACOUSTIC TRANSMISSION HOLES

(71) Applicant: LONGINESTENO TECHNOLOGY COMPLEX CORPORATION, New Taipei (TW)

(72) Inventor: Chao-Lang Wang, New Taipei (TW)

(73) Assignee: LONGINESTENO TECHNOLOGY COMPLEX CORPORATION, New Taipei (TW)

( * ) Notice: Subject to any disclaimer, the term of this patent is extended or adjusted under 35 U.S.C. 154(b) by 0 days. days.

(21) Appl. No.: 15/459,016

(22) Filed: Mar. 15, 2017

(51) Int. Cl.
*H04R 25/00* (2006.01)
*H04R 1/34* (2006.01)
*H04R 1/02* (2006.01)

(52) U.S. Cl.
CPC ..... *H04R 1/345* (2013.01); *H04R 1/025* (2013.01)

(58) Field of Classification Search
CPC ..... H04R 1/023; H04R 1/345; H04R 1/02; H04R 2499/13; H04R 2205/024; H04R 1/26
USPC ..... 381/387, 186, 355, 392; 181/144, 181/147–148, 199; D14/215, 207, 204, D14/219, 210, 214
See application file for complete search history.

(56) References Cited

U.S. PATENT DOCUMENTS

| | | | | |
|---|---|---|---|---|
| 8,757,317 | B1 * | 6/2014 | Wang | H04R 1/345 181/153 |
| 9,712,902 | B1 * | 7/2017 | Uziel | H04R 1/026 |
| 2012/0237069 | A1 * | 9/2012 | Harman | H04R 19/02 381/336 |
| 2014/0029781 | A1 * | 1/2014 | Valtchev | H04R 1/227 381/341 |

* cited by examiner

*Primary Examiner* — Matthew Eason
*Assistant Examiner* — Julie X Dang
(74) *Attorney, Agent, or Firm* — Bacon & Thomas, PLLC

(57) ABSTRACT

A directional loudspeaker box with directional acoustic transmission holes includes a hollow housing and a loudspeaker. The hollow housing is provided with a front opening at the front end and has a peripheral portion adjacent to the front opening and formed with a plurality of directional acoustic transmission holes. The loudspeaker is fixed in the hollow housing and generates sound that can propagate out of the hollow housing through the front opening and the directional acoustic transmission holes. The angle at which each directional acoustic transmission hole is formed with respect to the central axis of the loudspeaker is a function of the axial distance between the directional acoustic transmission hole and the loudspeaker, wherein the smaller the axial distance, the larger the angle, and the larger the axial distance, the smaller the angle. Thus, the directional loudspeaker box effectively deals with near- and far-field sound effects.

18 Claims, 10 Drawing Sheets

DIRECTIONAL LOUDSPEAKER BOX WITH DIRECTIONAL ACOUSTIC TRANSMISSION HOLES

FIELD OF THE INVENTION

The present invention relates to loudspeaker boxes and more particularly to one provided with a plurality of directional acoustic transmission holes whose angles with respect to the central axis of the loudspeaker vary with their respective axial distances to the loudspeaker so that sound can propagate out of the loudspeaker box in different directions to cater for listeners in both the near and far fields.

BACKGROUND OF THE INVENTION

The great leaps forward in industrial technology and continual development of multimedia products have enabled tremendous satisfaction of our senses of sight and hearing. In particular, many music companies nowadays have launched online music services that allow users to listen to music and songs directly through the Internet without having to buy CDs or vinyl records. As listening to music with earphones incurs compression, and hence discomfort, of the ears and keeps the listener from lying on one side of the body or making large movements at will, a desirable alternative is to play music through a stereo system, whose loudspeaker quality is also far superior to that of earphones and therefore ensures better enjoyment of music.

Generally, a stereo system designed to make the most of acoustic resonance to create a satisfactory sound field has a loudspeaker mounted in a loudspeaker box. The cavity in the box serves as a resonance chamber, which amplifies the sound output from the loudspeaker. Referring to FIG. 1, a conventional loudspeaker box L includes a hollow housing L1, a loudspeaker L2, and a cover L3. The hollow housing L1 is provided with an opening L11 at the front side and a receiving space L12 in its interior. The receiving space L12 is in communication with the opening L11 in order to receive a sound source control circuit L13. The loudspeaker L2 is mounted to the cover L3 and is electrically connected to the sound source control circuit L13 in order for the membrane of the loudspeaker L2 to vibrate according to audio signals transmitted from the sound source control circuit L13 and thereby produce the corresponding sound effects. The cover L3 is mounted to the hollow housing L1 to cover the opening L11. When the membrane of the loudspeaker L2 applies a rearward pushing force to the air in the hollow housing L1 by instantaneous vibrations, the hollow housing L1 resonates at a low frequency.

Since stereo systems can be used for different purposes and in different places (e.g., in the living room of a residence, in an outdoor plaza, at a concert venue, on an athletic field, etc.), people's requirements of such systems are not exactly the same, and in light of this, structural improvements have been made to loudspeaker boxes to meet user needs. The applicant of the present invention has found that the existing loudspeaker boxes can be roughly divided into two major categories: household loudspeaker boxes, whose range of sound projection is relatively small, and those for use with public address (PA) loudspeakers, which feature relatively far sound projection; and that a loudspeaker box that takes into account both near-field and far-field sound effects has yet to be developed. For example, a PA loudspeaker will produce an undesirable sound effect to those who are close to it (i.e., in the near field). After all, the placement of a loudspeaker box requires various spatial acoustic conditions to be considered. The issue to be addressed by the present invention, therefore, is to design a novel loudspeaker box structure configured for both the near and far fields in order to provide users with a better listening experience.

BRIEF SUMMARY OF THE INVENTION

In view of the fact that the conventional loudspeaker boxes may result in a less-than-satisfactory listening experience due to failure to accommodate both the near and far fields, the inventor of the present invention incorporated years of practical experience in the industry into extensive research and repeated trials and finally succeeded in developing a directional loudspeaker box with directional acoustic transmission holes as disclosed herein. It is hoped that the invention can furnish a more satisfactory listening experience and be favored by users.

It is an objective of the present invention to provide a directional loudspeaker box having directional acoustic transmission holes. The loudspeaker box includes a hollow housing and a loudspeaker. The hollow housing is barrel-shaped, is provided therein with a receiving space, and has a front end provided with a front opening in communication with the receiving space. A peripheral portion of the hollow housing that is adjacent to the front opening is formed with a plurality of directional acoustic transmission holes. Each directional acoustic transmission hole penetrates the hollow housing, is open on both the inner and outer walls of the hollow housing, and is in communication with the receiving space. The loudspeaker is fixed in the hollow housing and divides the receiving space into a front acoustic cavity and a rear acoustic cavity. The front opening and the directional acoustic transmission holes correspond to the front acoustic cavity. The central axis of the front opening coincides with that of the loudspeaker. The central axis of each directional acoustic transmission hole forms an included angle with the central axis of the loudspeaker, wherein the included angle is a function of the axial distance between the directional acoustic transmission hole and the loudspeaker along the axial direction of the hollow housing. More specifically, the smaller the axial distance, the larger the included angle, and the larger the axial distance, the smaller the included angle. Thus, the sound generated by the loudspeaker can travel through the front acoustic cavity and then propagate out of the front acoustic cavity in different directions via the front opening and the directional acoustic transmission holes. The barrel-shaped configuration of the directional loudspeaker box helps project the sound generated by the loudspeaker to a great distance while the directional acoustic transmission holes enhance the near-field sound effect.

Another objective of the present invention is to provide the foregoing directional loudspeaker box, wherein the hollow housing is provided therein with a spoiler portion. The spoiler portion is located between the front opening and the membrane of the loudspeaker along the same central axis thereof to form a compression channel in the front acoustic cavity. Thus, the sound generated by the loudspeaker can propagate out of the front acoustic cavity through the front opening under compression of the compression channel. The spoiler portion and the compression channel are designed to generate a turbulent flow in, reflect, compress, concentrate, and then release the air (or sound) in the hollow housing, thereby increasing the distance of acoustic transmission effectively.

Still another objective of the present invention is to provide the foregoing directional loudspeaker box, wherein the inner wall of the hollow housing is protrudingly provided with a plurality of spoiler plates respectively adjacent to the directional acoustic transmission holes. Each spoiler plate surrounds the inner periphery of the corresponding directional acoustic transmission hole such that a directional spoiler channel is formed between each spoiler plate and the corresponding directional acoustic transmission hole. Each directional spoiler channel is in communication with the front acoustic cavity at one end and with the corresponding directional acoustic transmission hole at the opposite end. The sound generated by the loudspeaker can travel through the front acoustic cavity, be reflected by the directional spoiler channels, and then propagate out of the front acoustic cavity in different projection directions via the directional acoustic transmission holes, wherein the projection direction varies with the axial distance between each directional acoustic transmission hole and the loudspeaker. More specifically, the smaller the axial distance, the larger the projection angle, and the larger the axial distance, the smaller the projection angle. Due to compression by the spoiler plates, the sound generated by the loudspeaker can propagate out of the front acoustic cavity in different directions, and the distance of acoustic transmission through each directional acoustic transmission hole is increased.

Yet another objective of the present invention is to provide the foregoing directional loudspeaker box, wherein the hollow housing is provided with a spoiler blade between each two adjacent directional acoustic transmission holes that are arranged along the axial direction of the hollow housing. Each spoiler blade is so configured that the central axes of two corresponding adjacent directional acoustic transmission holes form different included angles with the central axis of the loudspeaker respectively, wherein the smaller the axial distance between a directional acoustic transmission hole and the loudspeaker, the larger the included angle formed by the central axis of the directional acoustic transmission hole with the central axis of the loudspeaker, and the larger the axial distance, the smaller the included angle. Due to compression by the spoiler blades and the walls of the directional acoustic transmission holes, the sound generated by the loudspeaker can propagate not only out of the hollow housing but also in different directions through the directional acoustic transmission holes.

BRIEF DESCRIPTION OF THE SEVERAL VIEWS OF THE DRAWINGS

The above and other objectives, as well as the technical features and effects, of the present invention can be better understood by referring to the following detailed description of some illustrative embodiments in conjunction with the accompanying drawings, in which.

DETAILED DESCRIPTION OF THE INVENTION

Figure 1:
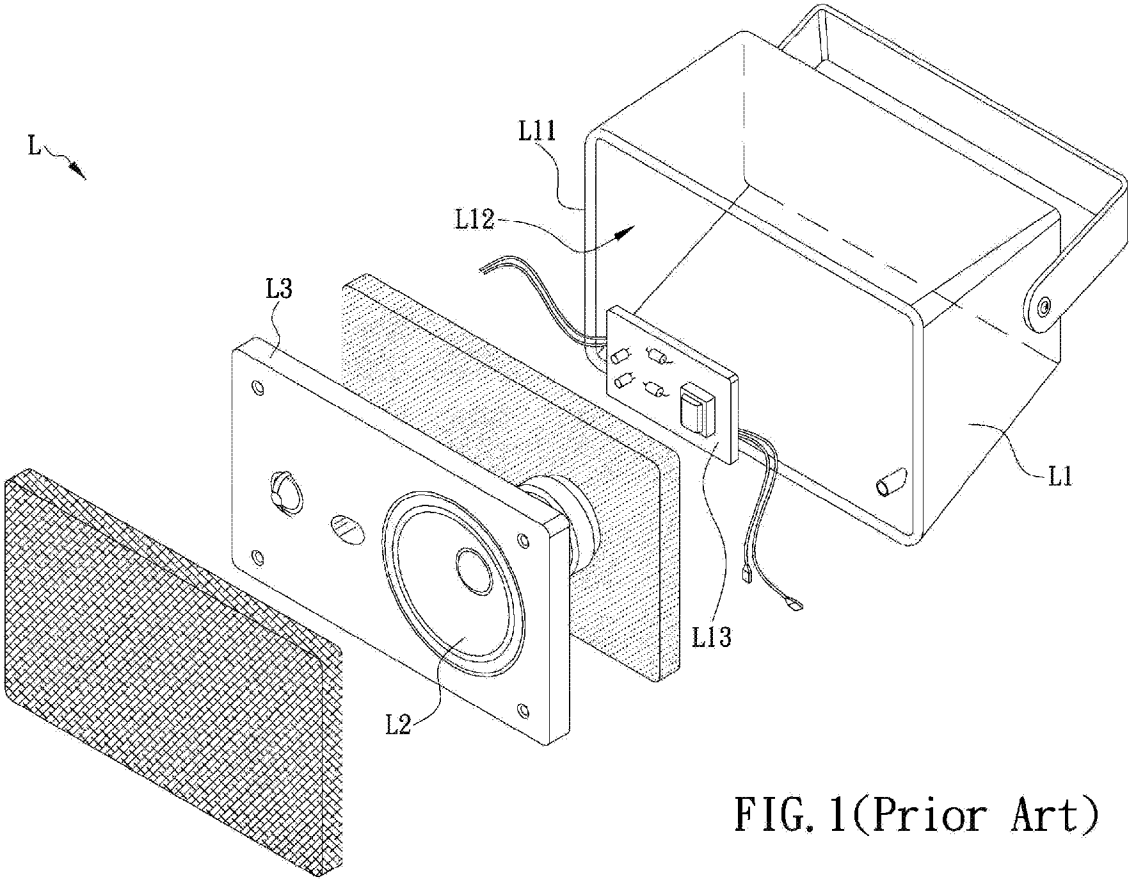
FIG. 1(Prior Art)
FIG. 1 is an exploded perspective view of a conventional loudspeaker box.
Figure 2:
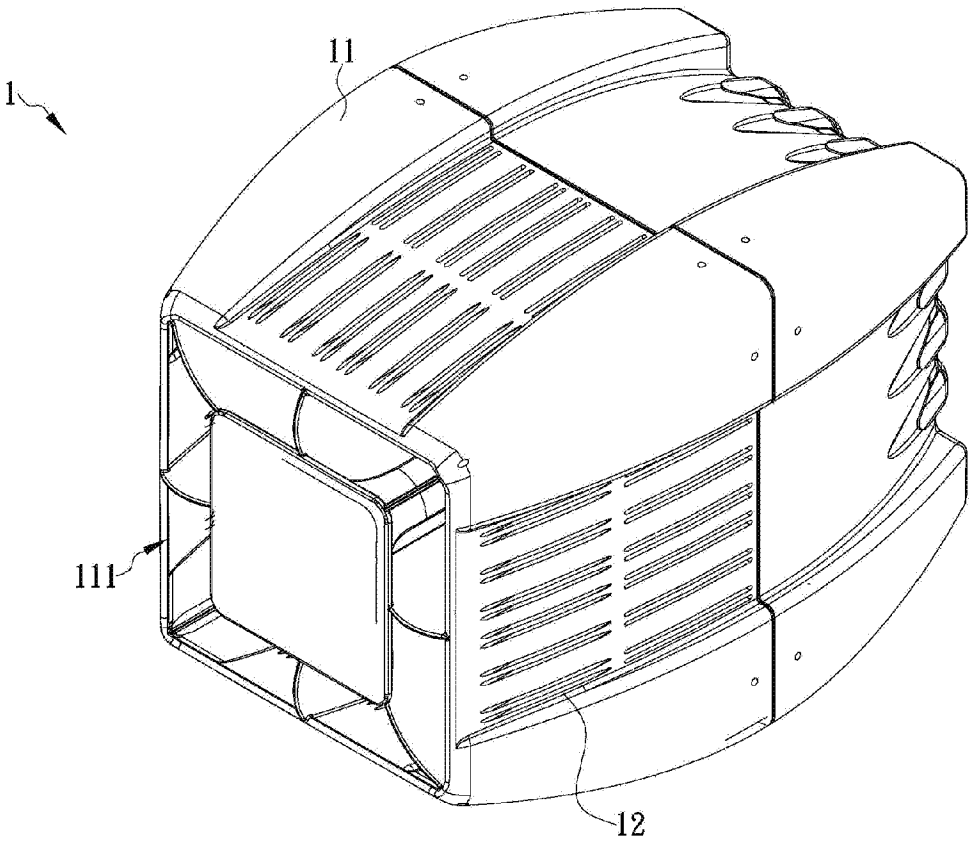
FIG. 2 is an assembled perspective view of the loudspeaker box in the first embodiment of the present invention.
Figure 3A:
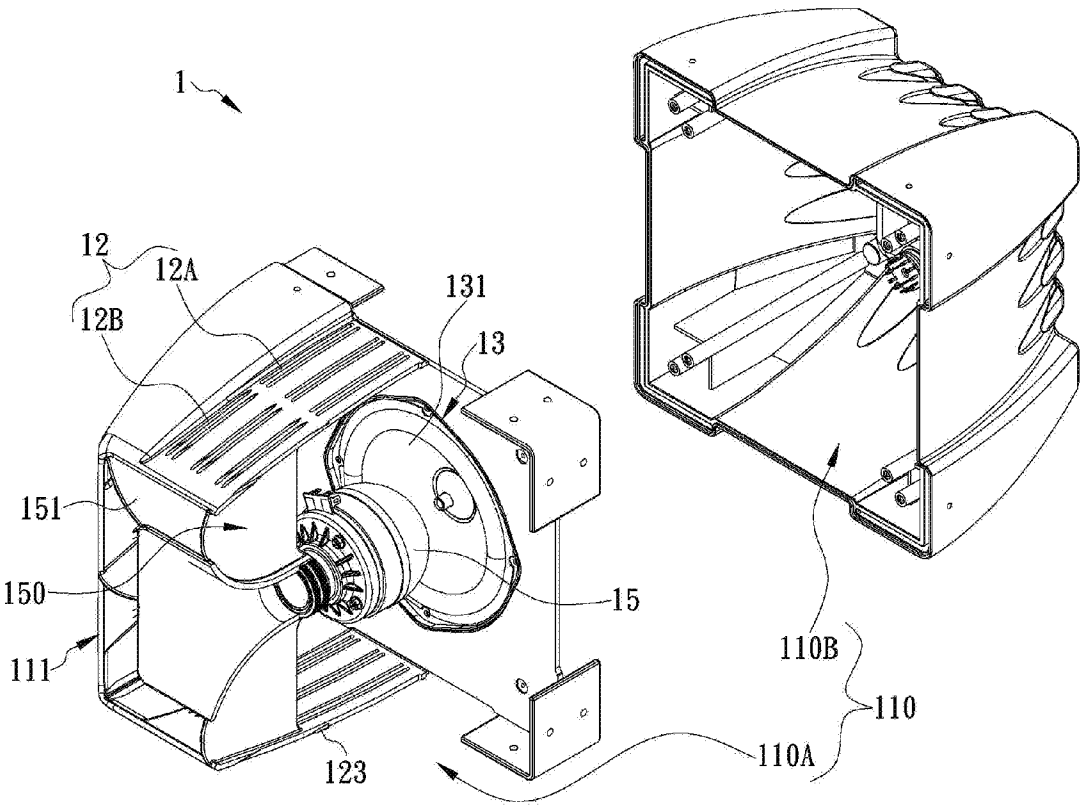
FIG. 3A is an exploded and partially cut-off view of the loudspeaker box in the first embodiment of the present invention.
Figure 3B:
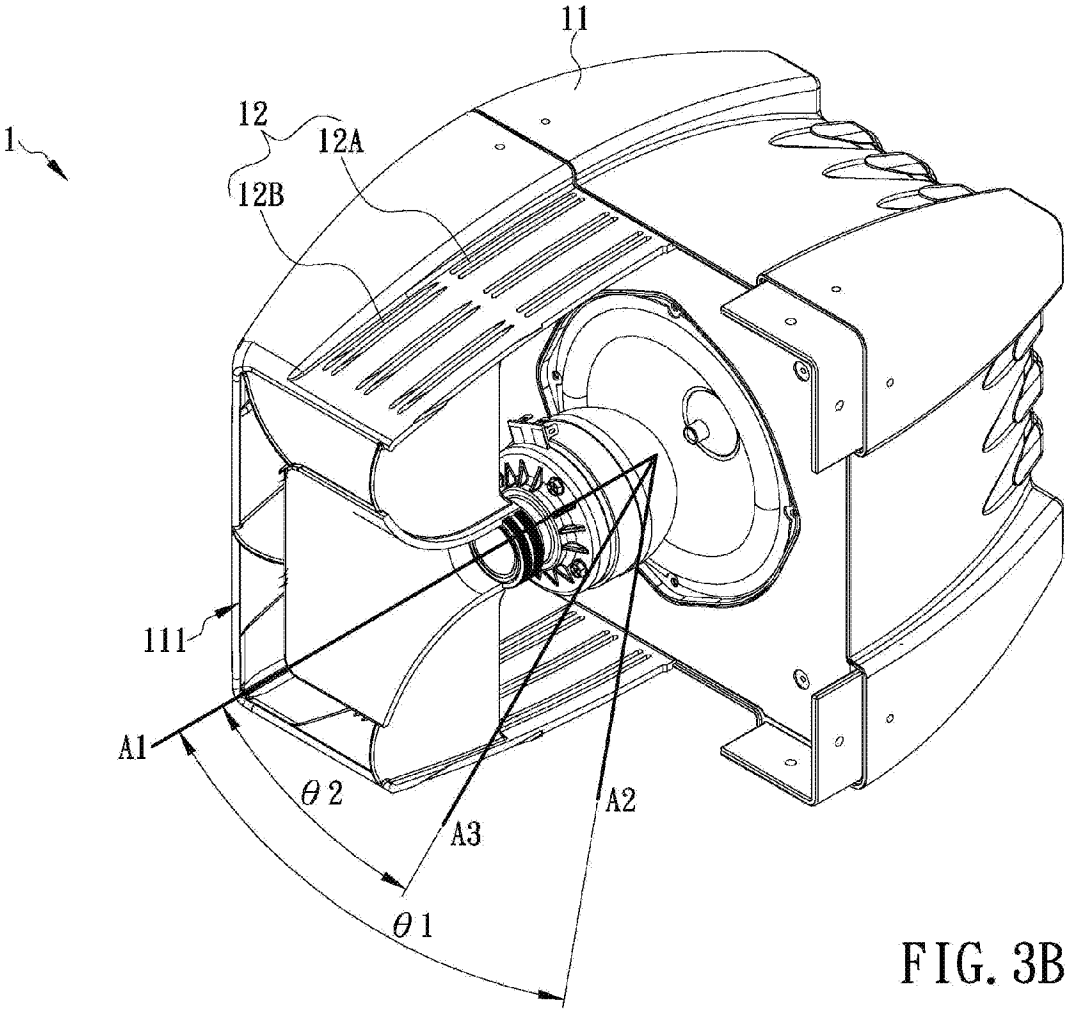
FIG. 3B is an assembled and partially cut-off view of the loudspeaker box in the first embodiment of the present invention.

The present invention provides a directional loudspeaker box having directional acoustic transmission holes. To facilitate description, the direction facing the lower left corner of FIG. 2 is defined as the front direction of a component; the direction facing the upper right corner of FIG. 2, as the rear direction of the component; the direction facing the upper left corner of FIG. 2, as the leftward direction of the component; and the direction facing the lower right corner of FIG. 2, as the rightward direction of the component. As shown in FIGS. 2, 3A, and 3B, the directional loudspeaker box 1 includes a hollow housing 11 and a loudspeaker 13. In the first embodiment, the hollow housing 11 is slightly barrel-shaped and is provided therein with a receiving space 110 for receiving the electronic elements (e.g., a sound source control circuit) required for normal operation of the directional loudspeaker box 1. As the arrangement of such electronic elements is well known in the art, no further description is provided herein, and the drawings omit such electronic elements for the sake of simplicity.

With continued reference to FIGS. 2, 3A, and 3B, the front end of the hollow housing 11 is provided with a front opening 111, and a peripheral portion of the hollow housing 11 that is adjacent to the front opening 111 is formed with a plurality of directional acoustic transmission holes 12. Each directional acoustic transmission hole 12 penetrates the hollow housing 11 and is open on the inner and outer walls of the hollow housing 11. Thus, the directional acoustic transmission holes 12 as well as the front opening 111 are in communication with the receiving space 110. It should be pointed out that while the directional acoustic transmission holes 12 are depicted in FIG. 2 as slits, they may in other embodiments of the present invention be circular, triangular, polygonal, wavy, or of other shapes to meet design requirements. Moreover, the directional acoustic transmission holes 12 may be arranged separately from one another or in an interconnected manner. The loudspeaker 13 is fixed in the hollow housing 11 and divides the receiving space 110 into a front acoustic cavity 110A and a rear acoustic cavity 110B. The front opening 111 and the directional acoustic transmission holes 12 correspond to the front acoustic cavity 110A. As shown in FIGS. 3A and 3B, the front opening 111 has the same central axis as the loudspeaker 13 (i.e., the axis A1 in FIG. 3B). Also, the loudspeaker 13 is electrically connected to the electronic elements in the hollow housing 11 in order to receive audio signals from the electronic elements and generate the corresponding sounds. In the first embodiment, the loudspeaker 13 has a membrane 131 facing the front acoustic cavity 110A. The membrane 131 has a central axis coinciding with that of the front opening 111 and is located behind the directional acoustic transmission holes 12 so that the sound generated by the loudspeaker 13 can propagate out of the front end of the hollow housing 11 through the front opening 111 and the directional acoustic transmission holes 12. As the hollow housing 11 is barrel-shaped and the loudspeaker 13 is located in the hollow housing 11, an inner wall portion of the hollow housing 11 that is adjacent to the front opening 111 will compress the air flowing through the front opening 111, and this compression enables the sound generated by the loudspeaker 13 to project outward over a great distance. Meanwhile, the directional acoustic transmission holes 12 contribute to enhancing the near-field sound effect.

Figure 3C:
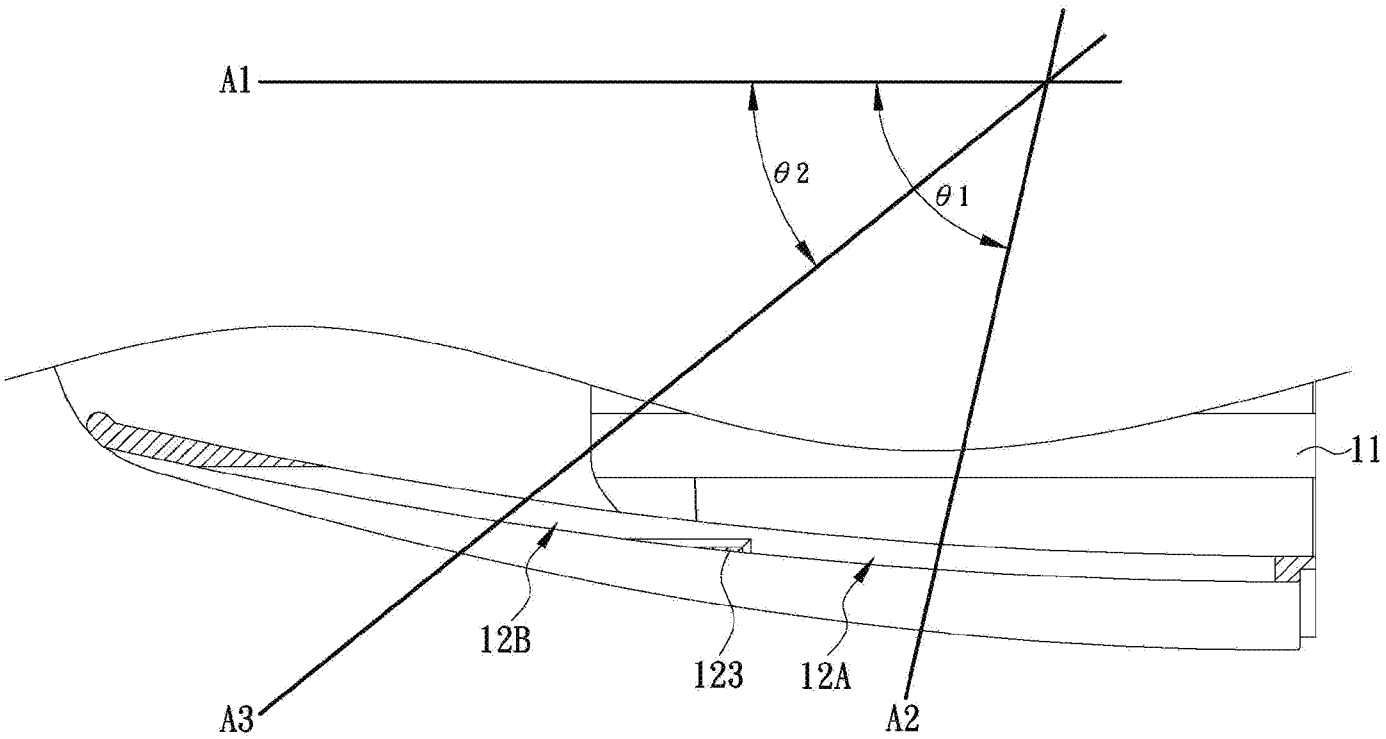
FIG. 3C is a partial sectional view of two directional acoustic transmission holes in the first embodiment of the present invention.

The structure of the directional acoustic transmission holes 12 of the present invention is detailed below with reference to FIGS. 2 and 3A-3C. As shown in the drawings, the central axis of each directional acoustic transmission hole 12 and the central axis of the loudspeaker 13 form an included angle therebetween, wherein the included angle is a function of the axial distance between the acoustic transmission hole 12 and the loudspeaker 13 in the axial direction of the hollow housing 11. In FIG. 3B, for example, the directional acoustic transmission holes 12 in the upper half of the hollow housing 11 are symmetric to and have the same structure as those in the lower half of the hollow housing 11, and the directional acoustic transmission holes 12 in the left half of the hollow housing 11 are symmetric to and have the same structure as those in the right half of the hollow housing 11. The axis A2 in FIGS. 3B and 3C is the central axis of the directional acoustic transmission hole 12A. The axis A2 of the directional acoustic transmission hole 12A forms an included angle θ1 with the axis A1 of the loudspeaker 13. The axis A3 in FIG. 3B is the central axis of the directional acoustic transmission hole 12B. The axis A3 of the directional acoustic transmission hole 12B forms another included angle θ2 with the axis A1 of the loudspeaker 13. As illustrated in FIGS. 3B and 3C, the axial distance between the central axis of the directional acoustic transmission hole 12A and the central axis of the loudspeaker 13 is relatively small, so the included angle θ1 corresponding to the directional acoustic transmission hole 12A is relatively large (about 75~90 degrees); the axial distance between the central axis of the directional acoustic transmission hole 12B and the central axis of the loudspeaker 13 is relatively large, so the included angle θ2 corresponding to the directional acoustic transmission hole 12B is relatively small (about 30 degrees). When the sound generated by the loudspeaker 13 propagates outward through the front acoustic cavity 110A, therefore, the directional acoustic transmission holes 12A and 12B guide the sound out of the front acoustic cavity 110A in different directions respectively.

To increase the distance of sound projection from the directional loudspeaker box 1, referring to FIGS. 2, 3A, and 3B, the hollow housing 11 has a larger inner diameter at the juncture between the front acoustic cavity 110A and the rear acoustic cavity 110B than in the other regions. In the first embodiment, the middle section of the hollow housing 11 has a larger inner diameter than the front section of the hollow housing 11 in order for the change in inner diameter to have the intended effect on the speed of airflow. The hollow housing 11 in the first embodiment is further provided therein with a spoiler portion 15 lying between the front opening 111 and the membrane 131 along the central axes thereof so as to form at least one compression channel 150 (i.e., the gap between the periphery of the spoiler portion 15 and the inner wall of the hollow housing 11) in the front acoustic cavity 110A. Thus, the airflow generated by vibrations of the membrane 131 will be compressed while passing through the space between the spoiler portion 15 and the corresponding inner wall portion of the hollow housing 11 and consequently be forced outward at high speed. In other words, the sound generated by the loudspeaker 13 will, together with the high-speed airflow, be subjected to such actions of the at least one compression channel 150 as reflection, compression, concentration, and release and propagate out of the front acoustic cavity 110A through the front opening 111; accordingly, the distance of acoustic transmission is effectively increased. It should be pointed out that, referring back to FIGS. 2, 3A, and 3B, the spoiler portion 15 may be a second loudspeaker having a smaller diameter and higher frequency than the loudspeaker 13. The second loudspeaker is provided with a plurality of connecting plates 151 that are connected to the inner wall of the front acoustic cavity 110A to form a plurality of compression channels 150. The sound generated by both the loudspeaker 13 and the second loudspeaker will propagate out of the front acoustic cavity 110A via the front opening 111 of the hollow housing 11 to satisfy user needs.

Figure 4:
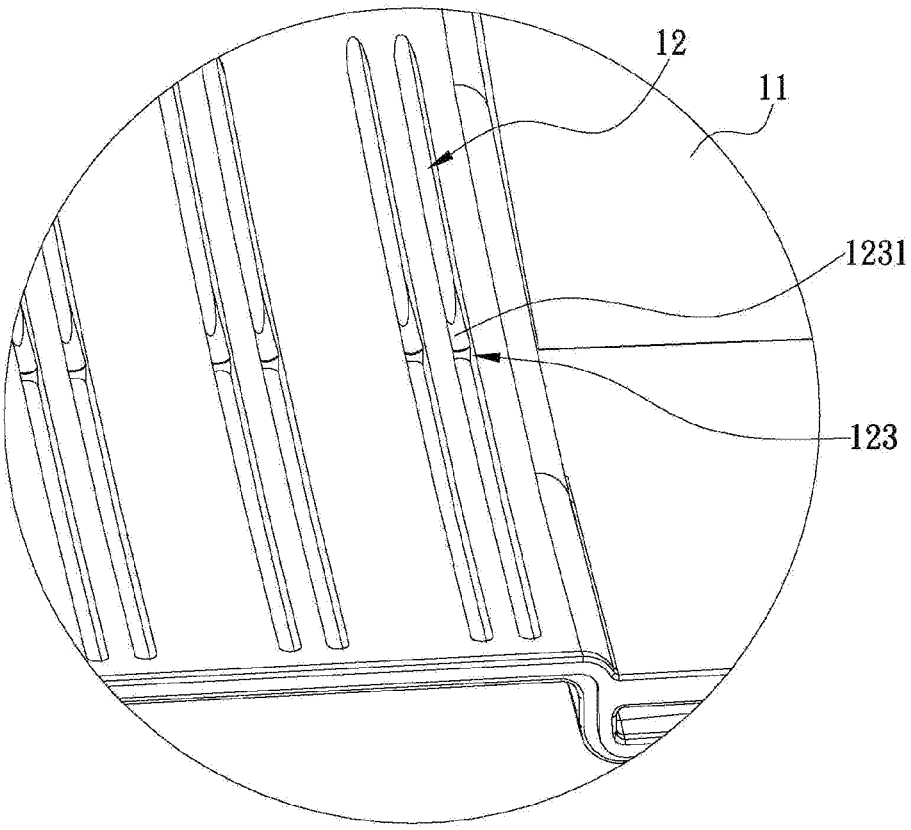
FIG. 4 is a perspective view of some directional acoustic transmission holes in the first embodiment of the present invention.

In the first embodiment, referring to FIGS. 2-4, each directional acoustic transmission hole 12 can be made in advance and then provided therein with at least one spoiler blade 123 to form the directional acoustic transmission hole 12A or 12B in FIG. 3B, wherein the spoiler blade 123 is configured in such a way (e.g., as having the inclined surface 1231 shown in FIGS. 3C and 4) that the central axes of two adjacent directional acoustic transmission holes 12A and 12B form different included angles with the central axis of the loudspeaker 13. More specifically, the smaller the axial distance between a directional acoustic transmission hole to the loudspeaker, the larger the included angle between the central axes of the directional acoustic transmission hole and of the loudspeaker, and the larger the axial distance, the smaller the included angle. As air flowing through each directional acoustic transmission hole 12 is compressed jointly by the hole wall and the corresponding spoiler blade 123 and is guided by the inclined surface 1231 of the corresponding spoiler blade 123, the sound propagating through each directional acoustic transmission hole 12 travels not only farther than without the corresponding spoiler blade 123, but also in a different direction outward of the front acoustic cavity 110A. In other embodiments of the present invention, however, it is feasible for each spoiler blade 123 to dispense with the inclined surface 1231. Thanks to the angle between the direction in which each directional acoustic transmission hole 12 opens and the opening direction of the front opening 111, the overall design of the directional loudspeaker box 1 provides higher sound quality by giving depth and transparency to the sound output from the directional loudspeaker box 1 and by projecting the sound farther and wider.

Figure 5:
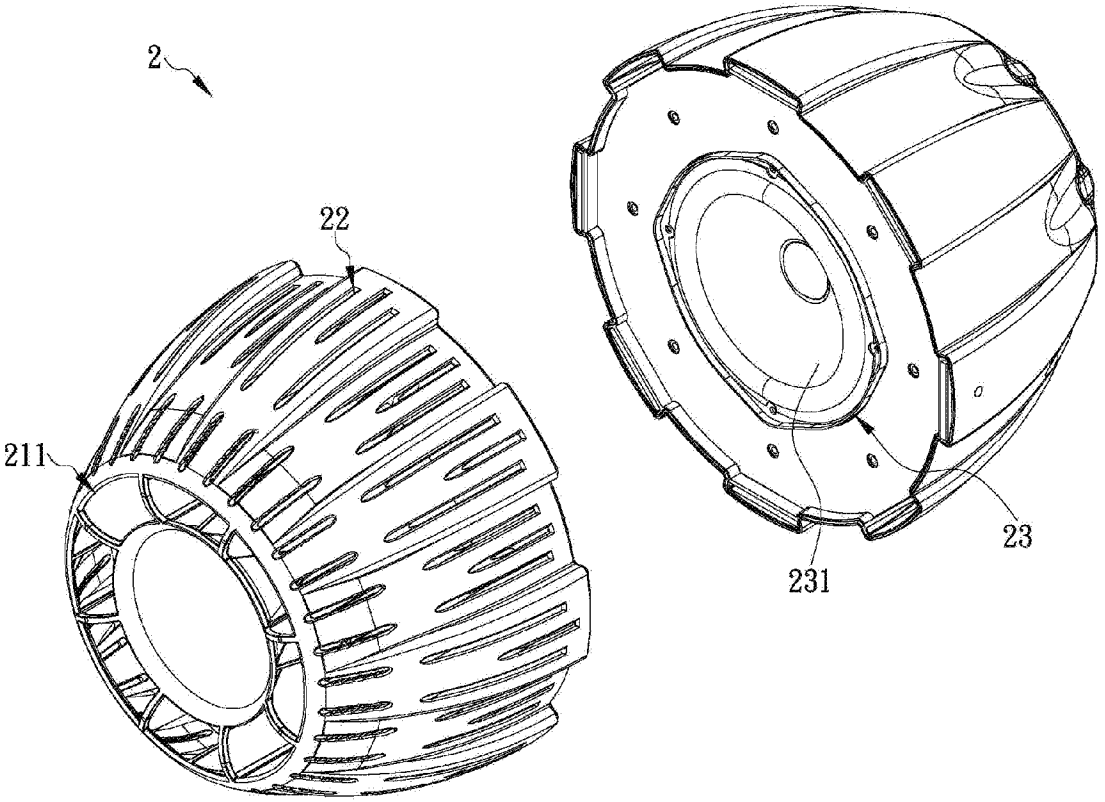
FIG. 5 is an exploded front view of the loudspeaker box in the second embodiment of the present invention.
Figure 6:
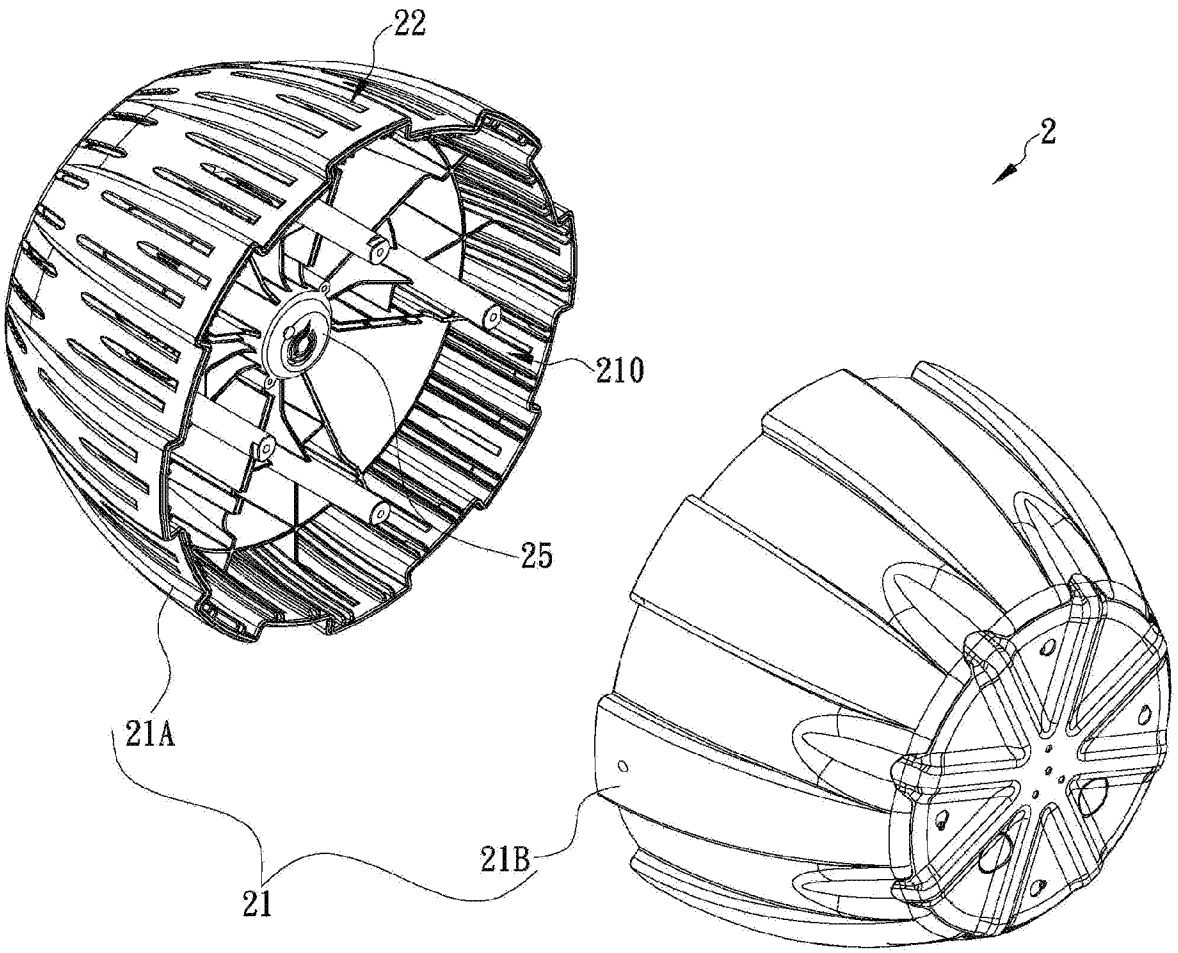
FIG. 6 is an exploded rear view of the loudspeaker box in the second embodiment of the present invention.

In the second embodiment of the present invention, referring to FIGS. 5 and 6, the directional loudspeaker box 2 includes a hollow housing 21, a loudspeaker 23, and a spoiler portion 25, wherein the hollow housing 21 is slightly barrel-shaped and is provided therein with a receiving space 210. In the second embodiment, the hollow housing 21 is assembled from a front housing 21A and a rear housing 21B, and yet the number of parts of the hollow housing 21 in other embodiments may vary according to product requirements. The front housing 21A is provided with a front opening 211 at the front end and is peripherally provided with a plurality of directional acoustic transmission holes 22 each penetrating the front housing 21A and opening on both the inner and outer walls thereof. The spoiler portion 25 is provided in the front housing 21A and forms a plurality of compression channels in the front housing 21A. The front opening 211 is in communication with the compression channels and the receiving space 210 while each directional acoustic transmission hole 22 is in communication with the corresponding compression channel and the receiving space 210.

Figure 7:
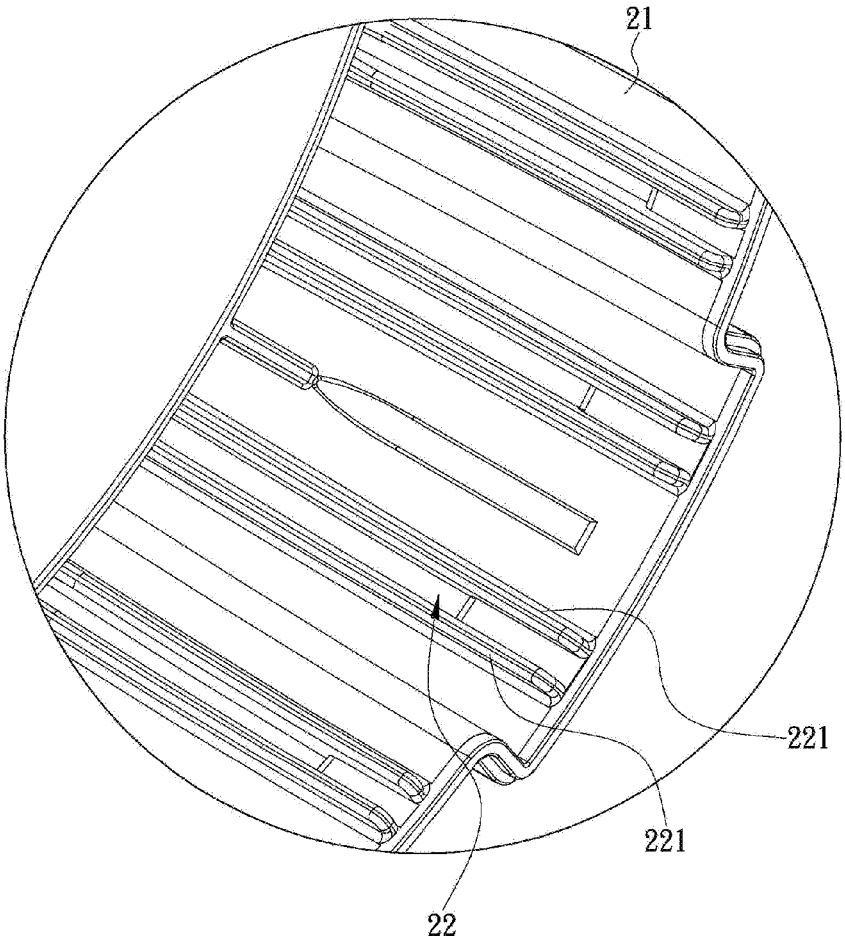
FIG. 7 is a perspective view of some directional acoustic transmission holes in the second embodiment of the present invention.
Figure 8:
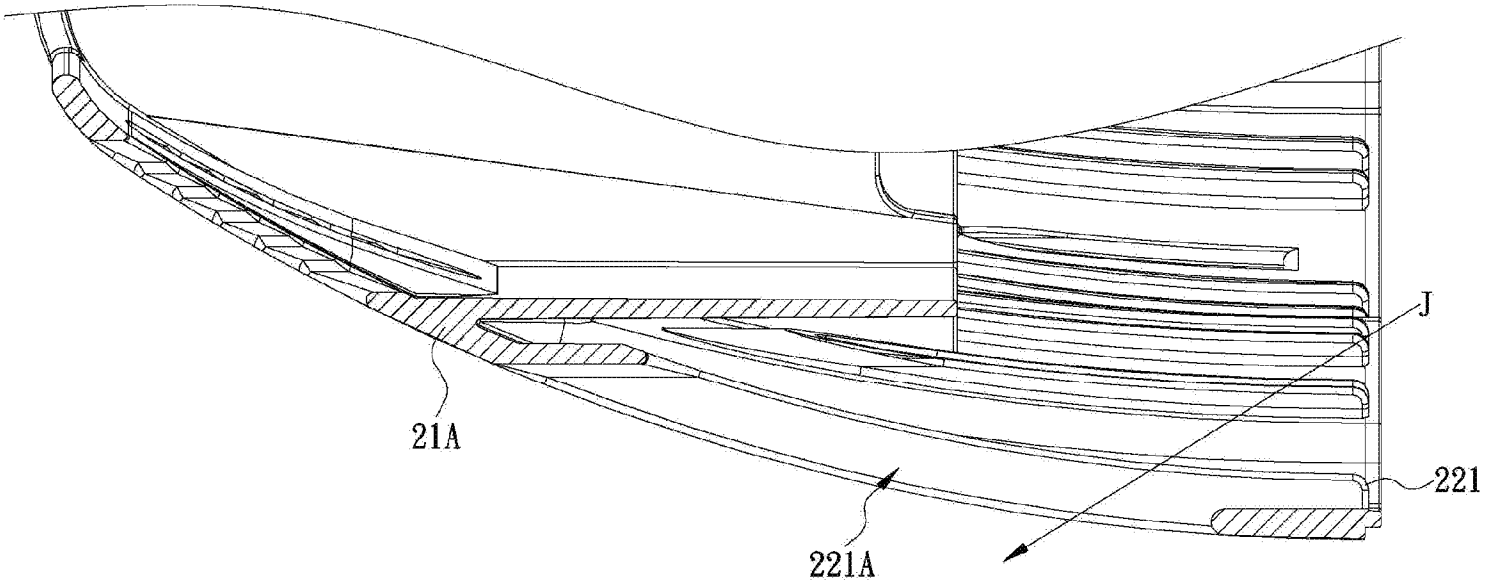
FIG. 8 is a partial sectional view of a directional acoustic transmission hole in the second embodiment of the present invention.

As shown in FIGS. 5 and 6, the loudspeaker 23 is provided in the rear housing 21B and divides the receiving space 210 into a front acoustic cavity and a rear acoustic cavity. That is to say, in the second embodiment, the front acoustic cavity is formed in the front housing 21A, and the rear acoustic cavity is formed in the rear housing 21B. Once the front housing 21A and the rear housing 21B are assembled together, the membrane 231 of the loudspeaker 23 is located behind the directional acoustic transmission holes 22. Moreover, in the second embodiment as shown in FIGS. 7 and 8, the inner wall of the hollow housing 21 is protrudingly provided with a spoiler plate 221 adjacent to each directional acoustic transmission hole 22. Each spoiler plate 221 extends toward the front acoustic cavity and surrounds the inner periphery of the corresponding directional acoustic transmission hole 22 such that a directional spoiler channel 221A is formed between each spoiler plate 221 and the corresponding directional acoustic transmission hole 22. Each directional spoiler channel 221A has one end in communication with the front acoustic cavity and the opposite end in communication with the corresponding directional acoustic transmission hole 22. Thus, the sound generated by the loudspeaker 23 can travel through the front acoustic cavity into the directional spoiler channels 221A and then propagate out of the front acoustic cavity in different projection directions (as indicated by the letter J in FIG. 8) through the directional acoustic transmission holes 22, depending on the axial distance between each directional acoustic transmission hole 22 and the loudspeaker 23, wherein the smaller the axial distance, the larger the angle of the projection direction with respect to the central axis of the loudspeaker 23, and the larger the axial distance, the smaller the angle. In order to apply the directional acoustic transmission holes 22 of the present invention to various types of loudspeaker boxes, however, it is feasible for the directional acoustic transmission holes 22 in other embodiments to dispense with additional elements or structures.

The embodiment described above is but a preferred one of the present invention and does not impose limitation on the technical features of the invention. All equivalent changes based on the technical contents disclosed herein and readily conceivable by a person of ordinary skill in the art should fall within the scope of the present invention.

What is claimed is:

1. A directional loudspeaker box with directional acoustic transmission holes, comprising:

a hollow housing formed as a barrel-shaped housing, wherein the hollow housing is provided therein with a receiving space, has a front end provided with a front opening in communication with the receiving space, and has a peripheral portion adjacent to the front opening and formed with a plurality of said directional acoustic transmission holes; and each said directional acoustic transmission hole penetrates the hollow housing, is in communication with the receiving space, and has a smaller area than the front opening; and a loudspeaker fixed in the hollow housing and dividing the receiving space into a front acoustic cavity and a rear acoustic cavity, wherein the front opening and the directional acoustic transmission holes correspond to the front acoustic cavity, the front opening has a central axis coinciding with a central axis of the loudspeaker, each said directional acoustic transmission hole has a central axis forming an included angle with the central axis of the loudspeaker, and each said included angle is a function of an axial distance between a corresponding said directional acoustic transmission hole and the loudspeaker along an axial direction of the hollow housing, wherein the smaller the axial distance between a said directional acoustic transmission hole and the loudspeaker, the larger the included angle formed by the central axis of the directional acoustic transmission hole with the central axis of the loudspeaker, and the larger the axial distance, the smaller the included angle.

2. The directional loudspeaker box of claim 1, wherein each said directional acoustic transmission hole is formed as a slit and has a longitudinal direction extending along the axial direction of the hollow housing.

3. The directional loudspeaker box of claim 2, wherein the loudspeaker comprises a membrane facing the front acoustic cavity, and the membrane has a central axis coinciding with the central axis of the front opening.

4. The directional loudspeaker box of claim 3, wherein the hollow housing is provided therein with a spoiler portion, and the spoiler portion lies between the front opening and the membrane along the central axes thereof to form a compression channel in the front acoustic cavity, in order for sound generated by the loudspeaker to propagate out of the front acoustic cavity through the front opening under compression of the compression channel.

5. The directional loudspeaker box of claim 4, wherein the hollow housing has a larger inner diameter at a juncture between the front acoustic cavity and the rear acoustic cavity than elsewhere of the hollow housing.

6. The directional loudspeaker box of claim 5, wherein the spoiler portion lying between the front opening and the membrane along the central axes thereof is a second loudspeaker, and the second loudspeaker has a central axis coinciding with the central axes of the front opening and of the membrane.

7. The directional loudspeaker box of claim 1, wherein the hollow housing is provided with a spoiler blade between each two adjacent said directional acoustic transmission holes that are arranged along the axial direction of the hollow housing, and each said spoiler blade is so configured that the central axes of two corresponding adjacent said directional acoustic transmission holes form different said included angles with the central axis of the loudspeaker respectively, wherein the smaller the axial distance between a said directional acoustic transmission hole and the loudspeaker, the larger the included angle formed by the central axis of the directional acoustic transmission hole with the central axis of the loudspeaker, and the larger the axial distance, the smaller the included angle.

8. The directional loudspeaker box of claim 2, wherein the hollow housing is provided with a spoiler blade between each two adjacent said directional acoustic transmission holes that are arranged along the axial direction of the hollow housing, and each said spoiler blade is so configured that the central axes of two corresponding adjacent said directional acoustic transmission holes form different said included angles with the central axis of the loudspeaker respectively, wherein the smaller the axial distance between a said directional acoustic transmission hole and the loudspeaker, the larger the included angle formed by the central axis of the directional acoustic transmission hole with the central axis of the loudspeaker, and the larger the axial distance, the smaller the included angle.

9. The directional loudspeaker box of claim 3, wherein the hollow housing is provided with a spoiler blade between each two adjacent said directional acoustic transmission holes that are arranged along the axial direction of the hollow housing, and each said spoiler blade is so configured that the central axes of two corresponding adjacent said directional acoustic transmission holes form different said included angles with the central axis of the loudspeaker respectively, wherein the smaller the axial distance between a said directional acoustic transmission hole and the loudspeaker, the larger the included angle formed by the central axis of the directional acoustic transmission hole with the central axis of the loudspeaker, and the larger the axial distance, the smaller the included angle.

10. The directional loudspeaker box of claim 4, wherein the hollow housing is provided with a spoiler blade between each two adjacent said directional acoustic transmission holes that are arranged along the axial direction of the hollow housing, and each said spoiler blade is so configured that the central axes of two corresponding adjacent said directional acoustic transmission holes form different said included angles with the central axis of the loudspeaker respectively, wherein the smaller the axial distance between a said directional acoustic transmission hole and the loudspeaker, the larger the included angle formed by the central axis of the directional acoustic transmission hole with the central axis of the loudspeaker, and the larger the axial distance, the smaller the included angle.

11. The directional loudspeaker box of claim 5, wherein the hollow housing is provided with a spoiler blade between each two adjacent said directional acoustic transmission holes that are arranged along the axial direction of the hollow housing, and each said spoiler blade is so configured that the central axes of two corresponding adjacent said directional acoustic transmission holes form different said included angles with the central axis of the loudspeaker respectively, wherein the smaller the axial distance between a said directional acoustic transmission hole and the loudspeaker, the larger the included angle formed by the central axis of the directional acoustic transmission hole with the central axis of the loudspeaker, and the larger the axial distance, the smaller the included angle.

12. The directional loudspeaker box of claim 6, wherein the hollow housing is provided with a spoiler blade between each two adjacent said directional acoustic transmission holes that are arranged along the axial direction of the hollow housing, and each said spoiler blade is so configured that the central axes of two corresponding adjacent said directional acoustic transmission holes form different said included angles with the central axis of the loudspeaker respectively, wherein the smaller the axial distance between a said directional acoustic transmission hole and the loudspeaker, the larger the included angle formed by the central axis of the directional acoustic transmission hole with the central axis of the loudspeaker, and the larger the axial distance, the smaller the included angle.

13. The directional loudspeaker box of claim 1, wherein the hollow housing has an inner wall protrudingly provided with a spoiler plate adjacent to each said directional acoustic transmission hole, each said spoiler plate extends toward the front acoustic cavity and surrounds an inner periphery of a corresponding said directional acoustic transmission hole such that each said spoiler plate and the corresponding directional acoustic transmission hole form a directional spoiler channel therebetween, and each said directional spoiler channel has an end in communication with the front acoustic cavity and an opposite end in communication with the corresponding directional acoustic transmission hole in order for sound generated by the loudspeaker and travelling through the front acoustic cavity to propagate out of the front acoustic cavity sequentially through the directional spoiler channels and the directional acoustic transmission holes and project in different projection directions depending on the axial distance between each said directional acoustic transmission hole and the loudspeaker, wherein the smaller the axial distance between a said directional acoustic transmission hole and the loudspeaker, the larger the projection angle corresponding to the directional acoustic transmission hole, and the larger the axial distance, the smaller the projection angle.

14. The directional loudspeaker box of claim 2, wherein the hollow housing has an inner wall protrudingly provided with a spoiler plate adjacent to each said directional acoustic transmission hole, each said spoiler plate extends toward the front acoustic cavity and surrounds an inner periphery of a corresponding said directional acoustic transmission hole such that each said spoiler plate and the corresponding directional acoustic transmission hole form a directional spoiler channel therebetween, and each said directional spoiler channel has an end in communication with the front acoustic cavity and an opposite end in communication with the corresponding directional acoustic transmission hole in order for sound generated by the loudspeaker and travelling through the front acoustic cavity to propagate out of the front acoustic cavity sequentially through the directional spoiler channels and the directional acoustic transmission holes and project in different projection directions depending on the axial distance between each said directional acoustic transmission hole and the loudspeaker, wherein the smaller the axial distance between a said directional acoustic transmission hole and the loudspeaker, the larger the projection angle corresponding to the directional acoustic transmission hole, and the larger the axial distance, the smaller the projection angle.

15. The directional loudspeaker box of claim 3, wherein the hollow housing has an inner wall protrudingly provided with a spoiler plate adjacent to each said directional acoustic transmission hole, each said spoiler plate extends toward the front acoustic cavity and surrounds an inner periphery of a corresponding said directional acoustic transmission hole such that each said spoiler plate and the corresponding directional acoustic transmission hole form a directional spoiler channel therebetween, and each said directional spoiler channel has an end in communication with the front acoustic cavity and an opposite end in communication with the corresponding directional acoustic transmission hole in order for sound generated by the loudspeaker and travelling through the front acoustic cavity to propagate out of the front acoustic cavity sequentially through the directional spoiler channels and the directional acoustic transmission holes and project in different projection directions depending on the axial distance between each said directional acoustic transmission hole and the loudspeaker, wherein the smaller the axial distance between a said directional acoustic transmission hole and the loudspeaker, the larger the projection angle corresponding to the directional acoustic transmission hole, and the larger the axial distance, the smaller the projection angle.

16. The directional loudspeaker box of claim 4, wherein the hollow housing has an inner wall protrudingly provided with a spoiler plate adjacent to each said directional acoustic transmission hole, each said spoiler plate extends toward the front acoustic cavity and surrounds an inner periphery of a corresponding said directional acoustic transmission hole such that each said spoiler plate and the corresponding directional acoustic transmission hole form a directional spoiler channel therebetween, and each said directional spoiler channel has an end in communication with the front acoustic cavity and an opposite end in communication with the corresponding directional acoustic transmission hole in order for sound generated by the loudspeaker and travelling through the front acoustic cavity to propagate out of the front acoustic cavity sequentially through the directional spoiler channels and the directional acoustic transmission holes and project in different projection directions depending on the axial distance between each said directional acoustic transmission hole and the loudspeaker, wherein the smaller the axial distance between a said directional acoustic transmission hole and the loudspeaker, the larger the projection angle corresponding to the directional acoustic transmission hole, and the larger the axial distance, the smaller the projection angle.

17. The directional loudspeaker box of claim 5, wherein the hollow housing has an inner wall protrudingly provided with a spoiler plate adjacent to each said directional acoustic transmission hole, each said spoiler plate extends toward the front acoustic cavity and surrounds an inner periphery of a corresponding said directional acoustic transmission hole such that each said spoiler plate and the corresponding directional acoustic transmission hole form a directional spoiler channel therebetween, and each said directional spoiler channel has an end in communication with the front acoustic cavity and an opposite end in communication with the corresponding directional acoustic transmission hole in order for sound generated by the loudspeaker and travelling through the front acoustic cavity to propagate out of the front acoustic cavity sequentially through the directional spoiler channels and the directional acoustic transmission holes and project in different projection directions depending on the axial distance between each said directional acoustic transmission hole and the loudspeaker, wherein the smaller the axial distance between a said directional acoustic transmission hole and the loudspeaker, the larger the projection angle corresponding to the directional acoustic transmission hole, and the larger the axial distance, the smaller the projection angle.

18. The directional loudspeaker box of claim 6, wherein the hollow housing has an inner wall protrudingly provided with a spoiler plate adjacent to each said directional acoustic transmission hole, each said spoiler plate extends toward the front acoustic cavity and surrounds an inner periphery of a corresponding said directional acoustic transmission hole such that each said spoiler plate and the corresponding directional acoustic transmission hole form a directional spoiler channel therebetween, and each said directional spoiler channel has an end in communication with the front acoustic cavity and an opposite end in communication with the corresponding directional acoustic transmission hole in order for sound generated by the loudspeaker and travelling through the front acoustic cavity to propagate out of the front acoustic cavity sequentially through the directional spoiler channels and the directional acoustic transmission holes and project in different projection directions depending on the axial distance between each said directional acoustic transmission hole and the loudspeaker, wherein the smaller the axial distance between a said directional acoustic transmission hole and the loudspeaker, the larger the projection angle corresponding to the directional acoustic transmission hole, and the larger the axial distance, the smaller the projection angle.

* * * * *